United States Patent [19]

Meyer

[11] 4,144,980

[45] Mar. 20, 1979

[54] UNIVERSAL EJECTOR BUCKET

[75] Inventor: Gustave Meyer, Northglenn, Colo.

[73] Assignee: The Egging Company, Gurley, Nebr.

[21] Appl. No.: 825,566

[22] Filed: Aug. 18, 1977

Related U.S. Application Data

[63] Continuation-in-part of Ser. No. 676,224, Apr. 12, 1976, abandoned.

[51] Int. Cl.[2] ..... E02F 3/81

[52] U.S. Cl. ..... 414/725; 37/DIG. 2; 414/704

[58] Field of Search ..... 214/146 E, 145 A, 767; 37/DIG. 2; 92/111

[56] References Cited

U.S. PATENT DOCUMENTS

| | | | |
|---|---|---|---|
| 2,577,462 | 12/1951 | Hackney | 92/111 X |
| 2,852,869 | 9/1958 | Beyerstedt | 214/146 E X |
| 2,886,005 | 5/1959 | Bryan | 92/111 X |
| 3,176,863 | 4/1965 | Kuhl | 214/146 E |
| 3,359,868 | 12/1967 | Hoffman et al. | 92/111 X |
| 3,512,665 | 5/1970 | Westendorf | 214/145 A |
| 3,837,516 | 9/1974 | Meyer | 214/767 |

*Primary Examiner*—L. J. Paperner
*Attorney, Agent, or Firm*—Kyle W. Rost

[57] ABSTRACT

An ejector bucket for mounting on a front end or backhoe loader vehicle, provided with an ejector actuated by a mechanism that does not protrude from the bucket walls. The actuating mechanism is contained within a small area behind the ejector and is attached to the rear of the ejector and the top wall of the bucket. The absence of protruding cylinders or the like makes the bucket mountable on loaders of all designs. Flexible means connect the actuating mechanism to the engine of the loader vehicle or other power source.

1 Claim, 6 Drawing Figures

UNIVERSAL EJECTOR BUCKET

CROSS REFERENCES

This is a continuation-in-part of application Ser. No. 676,224, filed Apr. 12, 1976, now abandoned.

BACKGROUND OF THE INVENTION

1. Field of the Invention

The invention relates to a universal loader bucket adapted to fit front end loaders and backhoe loaders of all descriptions. The bucket is provided with a self-contained ejector actuated by a mechanism carried within the framework of the bucket but outwardly of the working side of the ejector.

2. Description of the Prior Art

Buckets having ejector plates are known in a variety of configurations. These buckets are typically designed with a complex actuating linkage and are not adaptable for use with more than one design of loader vehicle. As a result, persons desiring the advantages of an ejector type loader bucket must usually purchase an entire loader.

A self-contained ejector type loader bucket is disclosed in U.S. Pat. No. 3,838,516, issued to applicant. That bucket was adaptable to many commercially popular loader vehicles; however, the actuating cylinder had its front portion pivotally connected to the rear wall of the bucket, causing the rear part of the cylinder to extend beyond the rear of the bucket. The protruding cylinder resulted in the bucket being less than universally applicable to loader vehicles. The present invention is an improved version of that disclosed in the above cited patent.

Many loaders are equipped to receive a variety of attachments on their loader arms, and different manufacturers have created devices for quickly changing the attachments. There is little uniformity among the quick attachment devices, except that one portion, for example a "female" structure, is permanently fastened to the attachment, and another portion, for example a "male" structure, is fastened to the loader arms. The female structure is often frame-like in shape and requires a planar surface upon which it is mounted. The male structure may be a plate, or a frame-like assembly. The variation in male structure accounts for the primary difficulty in creating a universal bucket, as each male structure is designed to avoid hydraulic cylinders and other protrusions only on buckets made specifically by the same manufacturer.

Hydraulic cylinders also create difficulties in adapting a bucket to universal fit, since hose connections protrude beyond the circumference of the cylinder, and the motion of an actuated cylinder may abrade the hose against the quick attachment device of the loader. Simply extending walls of the loader bucket to fully house the cylinder is unsatisfactory, since balance of many loaders is critical and excess weight on the bucket would make the bucket non-competitive with custom designed units. Therefore, it is necessary for a universal bucket to achieve a fit with all known quick attachment devices while not increasing the weight of material in the bucket over that of a custom designed unit for a given quick attachment device.

SUMMARY OF THE INVENTION

The present invention is an ejector bucket having an internally contained ejector and ejector actuating means and is characterized by the absence of protruding parts that interfere with means attaching the bucket to a loader vehicle. The bucket has side walls, a bottom wall, and a narrow top wall. A hinged ejector pivotally connected to the top wall is actuated by actuating means connecting the ejector and a wall such as the narrow top wall, the actuating means thereby being contained within the bucket.

An object of the invention is to provide an ejector bucket that contains its actuating means within the outlines of the bucket. While the ejector-type bucket is typically compact, this invention combines compactness with an absence of protruding hydraulic cylinders and the like.

Another object is to provide a loader bucket that retains the lightness characteristic of ejector-type buckets while containing the ejector actuating means. Ejector buckets as disclosed in U.S. Pat. No. 3,837,516 to Meyer have ejector plates that serve as an auxiliary rear wall and bottom, thereby lightening the bucket without detracting from its ability to perform its intended function. The present invention fully contains the ejector actuating means while retaining the lightness of the previously patented Meyer construction. Accordingly, the present construction contains the ejector actuating means without the mere extension of walls, as would add weight without adding to the efficiency of the bucket.

DESCRIPTION OF THE PREFERRED EMBODIMENT

Figure 2:
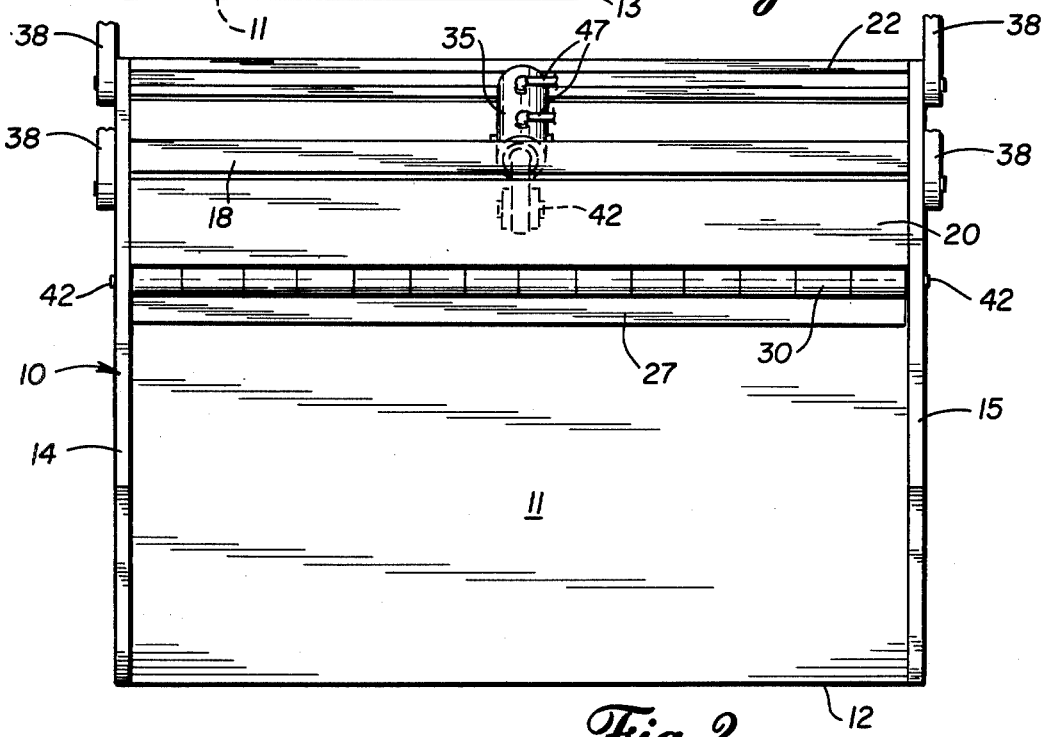
FIG. 2 is a top plan view of same.
Figure 3:
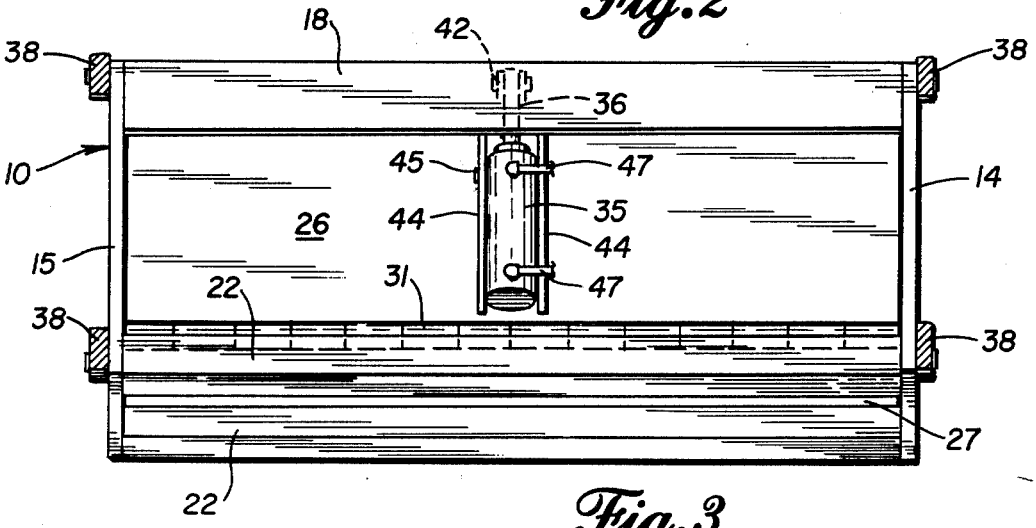
FIG. 3 is a rear elevational view of same.
Figure 4:
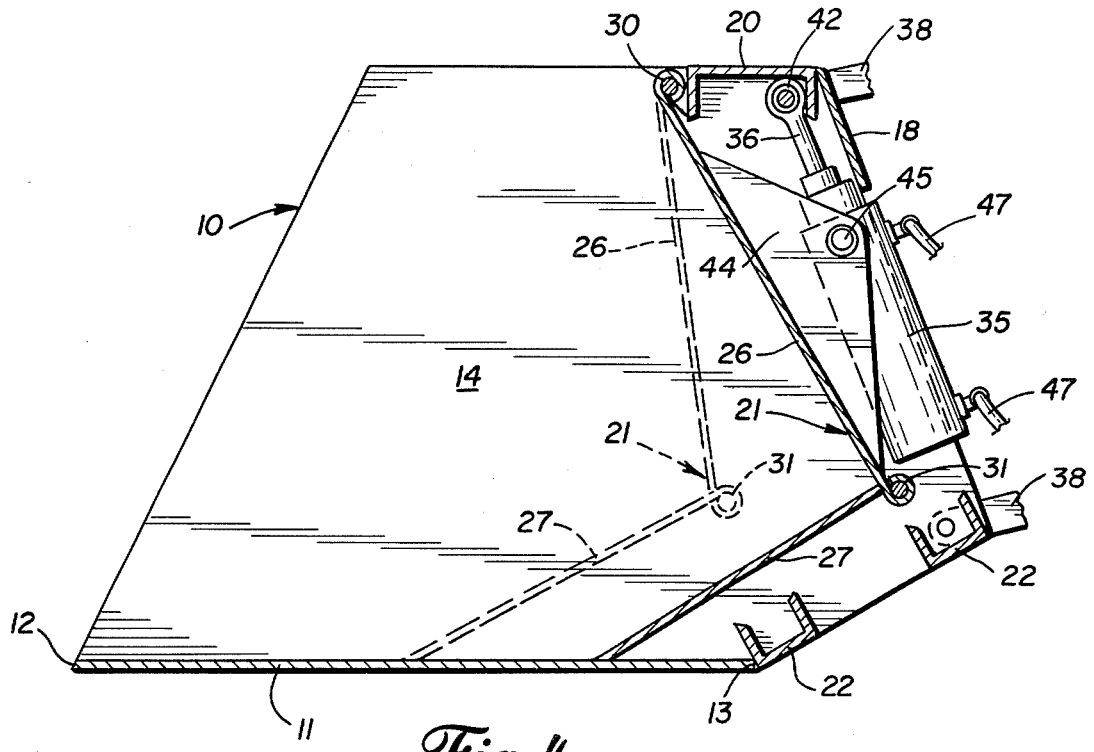
FIG. 4 is an enlarged transverse sectional view in the plane of line 4—4 of FIG. 3, showing in solid lines the ejector in retracted loading position, and in broken lines the ejector in a position intermediate its loading and full ejecting positions.
Figure 5:
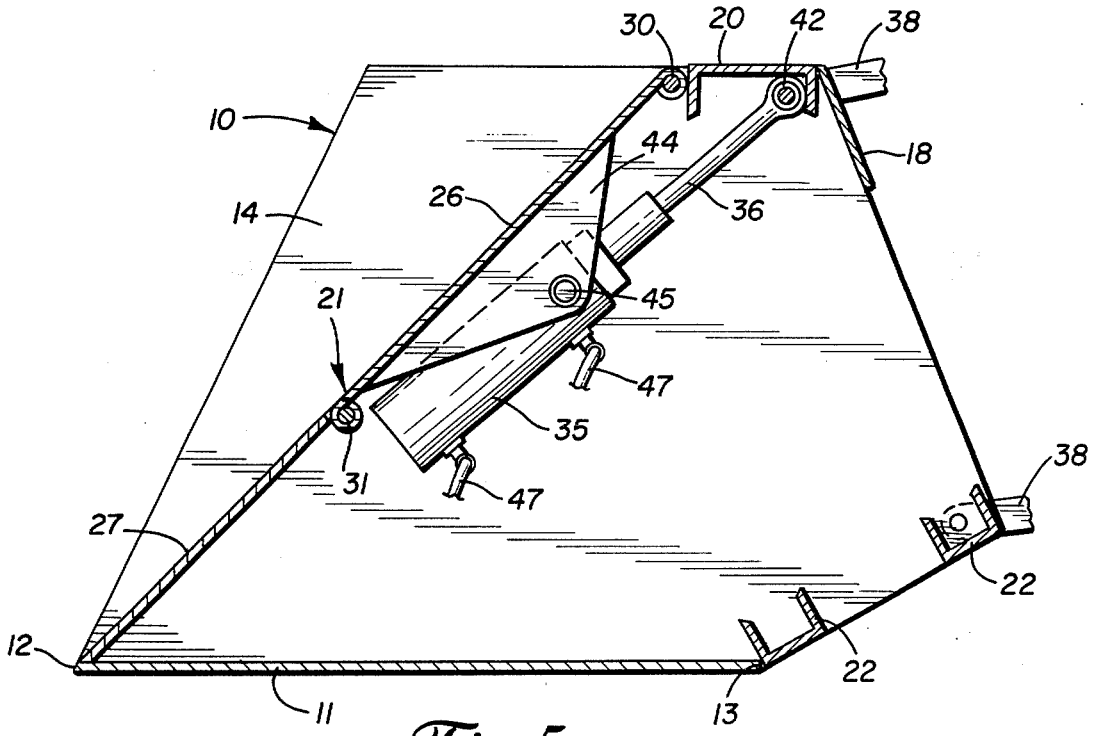
FIG. 5 is a transverse vertical sectional view similar to FIG. 4, showing the ejector and its actuating means in full ejecting position.

In the embodiment of the invention shown in the drawings, the ejector bucket 10 has a flat bottom 11 that extends across the bucket from side to side and from front edge 12 to rear edge 13. Side walls 14 and 15 have a horizontal lower edge a attached to the respective sides of bottom 11. The rear wall of the bucket 10 is upper panel 18 connected to the rear upper portion of the side walls 14 and 15. The horizontal top wall 20 is connected to the side walls 14 and 15 and extends longitudinally of the bucket, parallel to the bottom 11, and is relatively narrow transversely of the bucket as shown in FIGS. 2, 4, and 5, with the rear upper panel 18 extending at an obtuse angle thereto. The narrow top wall 20 assures good visibility to the operator of the vehicle of the interior of the bucket during loading, and also provides efficient mounting means for the ejector 21 pivotally connected to the top wall.

The bucket 10 may be made lighter than conventional dump buckets through the use of a frame-like rear wall. Upper panel 18 and structural members 22 provide strength across the rear of the bucket while otherwise leaving the rear open. The ejector 21 acts as a substitute rear wall and benefits from the open rear by having no area where foreign objects can lodge behind the ejector.

Ejector 21 comprises two flat plates 26 and 27, respectively, that extend longitudinally across the bucket between side walls 14 and 15. The upper plate 26 is relatively wide as compared to the lower plate 27. Hinge member 30 connects the top edge of upper plate 26 to the forward edge of top wall 20, and hinge member 31 connects the top edge of lower plate 27 to the edge of upper plate 26. Together, the ejector plates 26 and 27 extend from top wall 20 to bottom 11 with the bottom edge of plate 27 being slidable along bottom wall 11 when the ejector is actuated.

Universal adaptability of bucket 10 is achieved by locating the ejector activating means, for example double acting hydraulic cylinder 35 having piston 36, in the space behind the ejector plates and between side walls 14 and 15. This space provides an area for attaching pivotally mounted links 38 or other means for connecting the bucket 10 to a loader vehicle. The space also contains top wall 20 and structural members 22 or the like. The activating means is connected between top wall 20, for example at pivotable mount 42, and the rear of the ejector 21, for example at supports 44 having pivotable mounts 45. By placing the ejector activating means in the existing space behind the ejector, no part of the activating means need protrude from the rear of the bucket to a substantial degree, as would interfere with mounting the bucket 10 on known loaders. The activating means is connected to the engine of the loader vehicle by flexible means 47 that transmit operating power to the activating means.

As shown in FIGS. 4 and 5, the ejector activating means moves ejector plates 26 and 27 from retracted loading position shown in solid lines in FIG. 4 through the intermediate position shown in dashed lines and into the ejecting position shown in FIG. 5. The ejector is self cleaning when in the ejecting position, all structural members 22 and the top and bottom walls 20 and 11, respectively, being behind the extended plates. In contrast to traditional dump-style buckets, this bucket can eject its contents without tilting downwardly. The bucket is far more compact than prior art buckets of all descriptions since it has no protruding cylinders; yet, it can handle loads equal or larger than similar dump-style buckets.

It is to be understood that the ejector bucket of this invention may be embodied in any material handling equipment and is not limited to loader or backhoe loader vehicles. Further, the ejector actuating mechanism includes a hydraulic cylinder or other mechanical linkage or power, connected by any flexible means to the vehicle engine or other power source.

A universal ejector bucket of the type shown in the drawings is especially suited for use with quick attachment devices, for example as disclosed in U.S. Pat. No. 3,512,665 to Westendorf. Quick attachment devices generally consist of a framework or plate that is attached to the end of loader arms on an associated loader vehicle of any well known type, and a mating device that is attached to the bucket or other accessory to be temporarily connected to the loader arms. In typical operation, the plate and mating device are rapidly locked together by a manually operated latching means, enabling a user to substitute the bucket for some other accessory in a matter of minutes. The quick attachment device of choice may be selected by the owner of a loader vehicle, and the loader arms are then equipped with the appropriate plate or framework. All attachments to be used with that vehicle are equipped with the appropriate mating device.

Not only the bucket configuration, but also the cylinder configuration may prevent a bucket from being used with a chosen quick attachment device. The bulky shape of some cylinders may strike a portion of either the quick attachment plate or mating device, as there is no uniformity in design of the many quick attachment devices available. Even the location of hydraulic hose connections on a particular cylinder may interfere with a structural member of a given quick attachment device.

Figure 6:
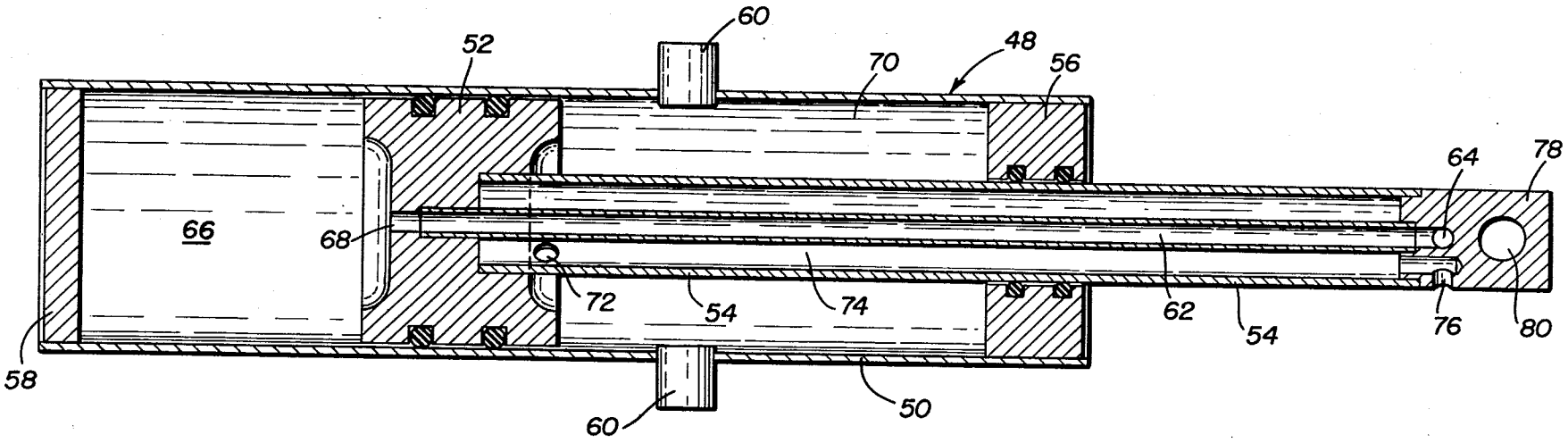
FIG. 6 is a longitudinal cross-sectional view of hydraulic cylinder suited for use in the ejector bucket.

The cylinder assembly 48 of FIG. 6 is designed especially for use on the ejector bucket and has the specific advantage of eliminating hydraulic hose fittings anywhere external of the circumference of the cylinder body 50. Fitting within body 50 is piston 52 attached to tubular piston rod 54 extending through sealing end plate 56 and having a diameter smaller than the diameter of cylinder 50. End 58, opposite from end 56, closes the cylinder. Cylinder 50 carries fastening means such as trunnion 60 for pivotal attachment to another object, such as to supports 44 of FIGS. 1–5.

Within piston rod 54 is tube 62 extending from external port 64 on the outer end of rod 54 to piston 52, where tube 62 continues through piston 52 and communicates with fluid chamber 66 adjacent to end 58 via orifice 68. The annular space 70 surrounding rod 54 within cylinder 50 on the side of piston 52 facing end 56 communicates with orifice 72, as does the interior 74 of rod 54 that is not occupied by tube 62. Orifice 72 may be in the side of rod 54 or located on an adjacent portion of piston 52. Both ends of piston 52 have a dished face containing the respective orifices 68 and 72. The hollow interior 74 of rod 54 also communicates with port 76 on coupling member 78, which seals the exterior end of the rod 54. Member 78 contains hole 80 for mounting to a mechanism to be acted upon by the cylinder, for example by pivotable mount 42 on top wall 20 of FIGS. 1–5. The cylinder 48 as described offers a uniquely compact structure that will fit within the area behind ejector plate 26 without interfering with a quick attachment device for the bucket. External hydraulic hoses 47 may be connected to ports 64 and 76 by conventional quick-disconnect fittings as are well known in the art and constitute no part of the present invention. Appropriate portions of such quick-disconnect hydraulic fittings may be threaded into ports 64 and 76. Obviously these ports may be at any desired location on coupling member 78. It is preferred to have both ports on one side of the member 78 so that the hoses 47 can approach the ports from a single side.

Having the ports 64 and 76 at the end of piston rod 54 has the double advantage of removing the hose connections from the sides of cylinder 50, which is the broadest part of the cylinder assembly, and also of locating the connections at substantially the narrowest part of the cylinder assembly, which is provided with a small amount of free space supplied by top wall 20. Furthermore, the tip of piston rod 54 has substantially less displacement, as compared to cylinder 50, and therefore subjects the hoses 47 to greatly reduced moving and flexing, which is especially important if the hoses have been threaded through a snug opening adjacent the quick attachment device used with the bucket.

Figure 1:
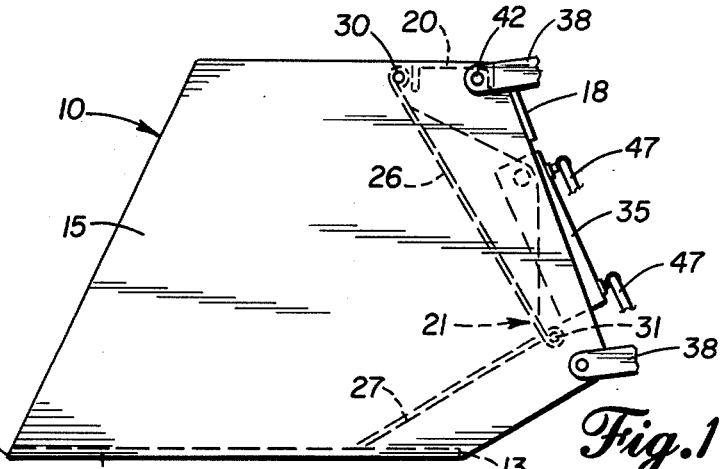
FIG. 1 is a side elevational view in partial section of the loader bucket and ejector in loading position.

In operation, cylinder assembly 48 is mounted in place of cylinder 35, and links 38 are eliminated from the bucket. The mating portion of the quick attachment device is welded or otherwise attached to the rear of the bucket. In FIGS. 1 and 4, it will be noted that a small fraction of the cylinder extends outwardly from the rear of the bucket. The thickness of this extension represents the thickness of the mating device, which is frame-like, and will be fully contained within the outlines of the bucket plus mating device. The bucket is then attached to a loader by coupling the quick attachment device and coupling the hydraulic hose quick-disconnects. It has been found that the arrangement of cylinder assembly 48 in bucket 10 is compatible with all known quick attachment devices, as the cylinder assembly cannot extend into a position to interfere with the loader mounted portion of the quick attachment device.

I claim:

1. An improved ejector bucket of the type having an open front, a substantially flat bottom wall, a top wall narrower than said bottom wall, opposite side walls connecting the bottom and top walls, and a frame-like planar rear wall having substantial sized opening therein, and further including an ejector having a pair of hingedly connected together plates, the first of the plates being an upper plate hingedly connected to the forward edge of said top wall and the second plated being a lower plate slidable along the inner surface of said bottom wall, said plates being moveable into a single plane load pushing position, the bucket being universally adaptable to loader vehicles using quick change attachments, wherein the improvement comprises:

(a) an ejector actuating hydraulic cylinder assembly substantially contained in the area between said top, bottom and opposite side walls, rearwardly of said ejector and substantially forwardly of said frame-like planar rear wall, the cylinder being connected between the rear of the ejector and the top wall of the bucket for moving the ejector plates into load discharge position, the mounting of the cylinder between the ejector and the frame-like planar rear wall allowing the bucket to be mounted on a loader without regard to positioning of structural members peculiar to a specific loader;

(b) said cylinder assembly including a hydraulic cylinder, a piston within the cylinder dividing the cylinder into first and second ends, and a piston rod connected to the piston and extending out the first end of the cylinder, the piston rod having a first tubular passage therein communicating with the first end of the cylinder and having a second tubular passage therein communicating with the second end of the cylinder, said first and second tubular passages having port means near the outer end of the piston rod for connection to hydraulic fluid supply lines;

(c) mounting means on the under surface of said top wall connected to the outer end of said piston rod for providing a relatively stationary mounting location for the hydraulic fluid supply lines;

(d) a trunnion mount on the exterior of said hydraulic cylinder;

(e) a laterally spaced pair of supports extending rearwardly from said upper ejector plate and adapted to pivotally support said trunnion mount with the cylinder therebetween; and (f) means independent of the hydraulic cylinder for mounting the bucket on a loader vehicle.

* * * * *